United States Patent [19]

Watanuki et al.

[11] Patent Number: 4,766,463

[45] Date of Patent: Aug. 23, 1988

[54] IMAGE FORMING APPARATUS

[75] Inventors: Masayoshi Watanuki; Tsutomu Shoji; Yukio Noguchi, all of Yokohama; Tadahide Sawamura, Tokyo, all of Japan

[73] Assignee: Ricoh Company, Ltd., Tokyo, Japan

[21] Appl. No.: 64,542

[22] Filed: Jun. 22, 1987

[30] Foreign Application Priority Data

Jun. 20, 1986 [JP] Japan ..... 61-142870
Jun. 30, 1986 [JP] Japan ..... 61-151386

[51] Int. Cl.[4] ..... G03G 15/00
[52] U.S. Cl. ..... 355/145 H; 355/3 SH
[58] Field of Search ..... 355/14 SH, 3 SH

[56] References Cited

U.S. PATENT DOCUMENTS 4,589,765 5/1986 Perun et al. ..... 355/3 SH
4,669,853 6/1987 Sosinski et al. ..... 355/3 SH
4,681,313 7/1987 Yokovama et al. ..... 355/14 SH X
4,696,564 9/1987 Watanabe ..... 355/3 SH X

*Primary Examiner*—A. C. Prescott
*Attorney, Agent, or Firm*—Oblon, Fisher, Spivak, McClelland & Maier

[57] ABSTRACT

An image forming apparatus has a latent image carrier for carrying an electrostatic latent image formed thereon. The electrostatic latent image is developed into a visible image which is transferred from the latent image carrier onto a transfer sheet in an image transfer region. The transfer sheet is held on a drum-shaped or a belt-shaped holder with the leading end clamped by a clamp. For efficient image formation, the holder is accelerated and decelerated while the transfer sheet is out of the image transfer region. When the transfer sheet with the transferred image thereon is sent to an image fixing device, the holder is accelerated and decelerated during an interval after the trailing end of the transfer sheet has left the image transfer region and before the leading end of the transfer sheet reaches the image fixing device. After the holder has been accelerated and decelerated, it is positionally adjusted when required.

9 Claims, 8 Drawing Sheets

IMAGE FORMING APPARATUS

BACKGROUND OF THE INVENTION

1. Field of the Invention:

The present invention relates generally to an image forming apparatus, and more particularly to an image forming apparatus for forming an image by developing an electrostatic latent image on a latent image carrier into a visible image thereon and transferring the visible image onto a transfer sheet held on a drum-shaped or belt-shaped holder.

2. Discussion of Background:

Image forming apparatus of the type described are actually used as copying machines, color copying machines, monochromatic copying machines with an editing capability, printing machines, and various electrostatic recorders. These machines or apparatus are generally designed to use transfer sheets of plural sizes. Therefore, holders for holding these transfer sheets have to have a peripheral length capable of holding transfer sheets of the longest size.

The period of time required to transfer a visible image onto a transfer sheet is proportional to the length of the visible sheet, i.e., the length of the transfer sheet.

Where the speed of rotation of a holder is constant, the time required to transfer a visible image is determined by the longest size of transfer sheet irrespective of the length of a transfer sheet used for the image transfer. This is problematic since when a visible image is transferred several times as in a color copying machine, the efficiency of image recording is low if a shorter transfer sheet is employed. Stated otherwise, if the length of a transfer sheet is smaller, the time needed for visible image transfer is also shorter correspondingly, and an image can be formed with higher efficiency by shortening the time interval between consecutive image transfer cycles.

To achieve greater image forming efficiency, there has been proposed a method of speeding up an image forming process by accelerating and decelerating the rotation of a transfer sheet holder during an interval after one transfer cycle has been completed and before a next transfer cycle is started (see Japanese Laid-Open Patent Publication No. 60-218673).

The proposed method is effective in increasing the speed of the image forming process, but suffers various problems which should be solved before the method can be reduced into practice.

Take, for example, a color copying machine employing fixing rollers as an image fixing device. A transfer sheet onto which a number of visible images have been transferred as a combined color visible image is separated from a holder and fed into the image fixing device in which the color visible image is fixed under pressure and heat to the transfer sheet which is thereafter discharged out of the copying machine. Where the transfer sheet is long, it may happen, after the final visible image has been transferred, for the leading end of the transfer sheet carrying the colored image to be gripped and fed by the fixing rollers when the trailing end of the transfer sheet has just passed through an image transfer region within the copying machine. Since the fixing rollers normally rotate at a constant speed, if a transfer drum holding the transfer sheet as the holder were accelerated while the leading end of the transfer sheet is being gripped by the fixing rollers, then the transfer sheet would sag in front of the fixing rollers, allowing unfixed toner on the transfer sheet to be attached to neighboring members of the machine. The toner image would then be ruined.

To overcome such a problem, it would be possible to control, i.e., accelerate and decelerate, the fixing rollers in timed relation to the transfer drum. Inasmuch as the amount of heat generated by the fixing rollers per unit time remains constant, however, sufficient heat would not be applied to the transfer sheet when the fixing rollers would be rotated at a higher speed, and toner would not be well fixed. The amount of heat from the fixing rollers might be increased during rotation of the fixing rollers at a higher speed. Toner would not be well fixed, however, unless the speed control of the fixing rollers and the heat control of the same were effected in precisely timed relation.

Thus, acceleration and deceleration of the holder requires the positional relationship between the image transfer region and the image fixing device to be taken into consideration. Where a heated plate or an infrared heater which does not grip a transfer sheet is employed as the image fixing device, the transfer sheet does not sag, but the problem of irregular heat application and hence an image fixing failure remains unsolved since the speed of travel of the transfer sheet varies with acceleration and deceleration of the holder.

The positional relationship between the image transfer region and a clamp device should also be considered. The leading end of a transfer sheet is clamped by a clamp of the holder. The clamp device is disposed in a space within the image forming apparatus and positioned so as to cause the clamp to clamp the leading end of the transfer sheet. When the leading end of the transfer sheet is clamped, the clamp passes through the clamp device. If the holder as it rotates were accelerated and decelerated at this time, the clamp would fail to clamp the sheet unless the rotation of a resist roller for delivering the transfer sheet were controlled in synchronism with the holder. Such control of the rotation of the resist roller would however require a complex mechanism.

No problem will arise if acceleration and deceleration of the holder are controlled using a large-size, large-capacity motor for driving the holder. However, if a small-size, small-capacity motor were used for driving the motor in order to make the image forming apparatus smaller in size and lower in cost, acceleration and deceleration of the holder would not be controlled correctly. As a result, the holder would not rotate in timed relation to an optical scanner and a photosensitive body as a latent image carrier which rotates in synchronism with the optical scanner, resulting in an image transfer failure.

The invention disclosed in Japanese Laid-Open Patent Publication No. 60-218673 is not addressed to the various problems described above, and is disadvantageous as to operation reliability.

SUMMARY OF THE INVENTION

It is an object of the present invention to provide an image forming apparatus capable of effectively preventing a transfer sheet from sagging and preventing a toner fixing failure due to irregular heat application by taking into account the positional relationship between an image transfer region and an image fixing device in the control of acceleration and deceleration of a holder which holds the transfer sheet.

Another object of the present invention is to provide an image forming apparatus which is designed by taking into account the length of a transfer sheet and the positional relationship between an image transfer region and an image fixing device in the control of acceleration and deceleration of a holder which holds the transfer sheet.

Still another object of the present invention is to provide an image forming apparatus which can effectively correct a positional deviation of a transfer sheet with respect to a vibible image to be transferred thereonto in the control of acceleration and deceleration of a holder which holds the transfer sheet.

A further object of the present invention is to provide an image forming apparatus which effectively prevents a sheet clamping failure by taking into account the positional relationship between an image transfer region and a clamp device in the control of acceleration and deceleration of a holder which holds the transfer sheet.

A still further object of the present invention is to provide an image forming apparatus which is designed by taking into account the length of a transfer sheet and the positional relationship between an image transfer region and a clamp device in the control of acceleration and deceleration of a holder which holds the transfer sheet.

According to the present invention, an electrostatic latent image is formed on a latent image carrier and developed into a visible image thereon. The electrostatic latent image can be formed by any of various known processes. For example, a photoconductive photosensitive body may be used as the latent image carrier. After the latent image carrier has been uniformly charged, it may be exposed to a light image or a light beam or light from an LED array may be applied to the latent image carrier to form the latent image thereon.

The latent image may be developed by any of various conventional development processes. Some wet-type development processes require no image fixing after image development. Where any of such wet-type development processes is employed, the positional relationship between an image transfer region and an image fixing device does not require any consideration, but only the positional relationship between the image transfer region and a clamp device should be taken into account.

The visible image is transferred from the latent image carrier onto a transfer sheet which is generally of paper. The transfer sheet is held on a drum-shaped or belt-shaped holder having a clamp. The transfer sheet is delivered onto the holder at a sheet clamping position and its leading end is clamped by the clamp.

The holder is accelerated and decelerated for speeding up an image forming process.

In order to take into account the positional relationship between an image fixing device and the image transfer region and to effectively prevent the transfer sheet from being flexed and an image fixing failure due to irregular heat application in such an image forming apparatus, the holder is controlled as follows:

When the transfer sheet is delivered from the image transfer region to the image fixing device, the holder is accelerated immediately after the trailing end of the transfer sheet has left the image transfer region, and is decelerated to a normal speed before the leading end of the transfer sheet reaches the image fixing device.

When the holder starts being accelerated, the trailing end of the transfer sheet is still on the holder. Therefore, as the holder is accelerated, the speed of delivery of the transfer sheet is also increased. The delivery of the transfer sheet is decelerated before the leading end of the transfer sheet reaches the image fixing device. Therefore, the transfer sheet is fed into the image fixing device at a normal speed, so that the transfer sheet is prevented from being unduly flexed and no image fixing failure occurs.

The above acceleration/deceleration control can be effected where the length of a feed path for the transfer sheet from the image transfer region to the image fixing device is greater than the maximum transfer sheet length.

Where the difference between the feed path length and the transfer sheet length is not substantially large, the holder may be decelerated immediately after it has started to be accelerated. In such a case, the image forming process will not be speeded up to a substantial extent even by accelerating and decelerating the holder. Thus, where the difference between the feed path length and the transfer sheet length is smaller than a certain value and no effective holder acceleration and deceleration are possible, the holder may not be accelerated and decelrated.

In the event that a transfer sheet longer than the feed path length is employed, the length of the transfer sheet should be taken into consideration so as to avoid image disturbance due to flexing of the transfer sheet and an image fixing failure. More specifically, if the transfer sheet used is longer than the feed path length and when the transfer sheet is delivered to the image fixing device, the leading end of the transfer sheet already enters the image fixing device at the time the trailing end of the transfer sheet leaves the image transfer region. Therefore, the holder is not accelerated and decelerated where a transfer sheet longer than the feed path length is used. Additionally, as described above, the holder is also not accelerated and decelerated where a transfer sheet used is shorter than the feed path length but the difference between the transfer sheet length and the feed path length is smaller than a certain value and any holder acceleration and deceleration are not effective in speeding up the image forming process.

In a color copying machine, several visible images are transferred onto a transfer sheet to produce a single colored image. The holder is accelerated and decelerated after all the visible images have been transferred onto the transfer sheet and when the transfer sheet is delivered to the image fixing device. Before all the visible images are transferred onto the transfer sheet, the holder may be accelerated and decelerated in order to reduce a time period before a next image transfer cycle after the trailing end of the transfer sheet has left the image transfer region in one image transfer cycle. It is also possible to disable acceleration and deceleration of the holder between successive image transfer cycles.

In case the holder is accelerated and decelerated between successive image transfer cycles, the transfer sheet and a next image to be transferred thereonto may be brought out of proper registry upon acceleration and deceleration of the holder after one image transfer cycle and before a next image transfer cycle. To prevent the transfer sheet and such a next image from being deviated, there are employed, as positional deviation correcting means, positioning reference signal setting means for setting a positioning reference signal, after one of the visible images has been transferred onto the transfer sheet, to relatively position the transfer sheet and a next visible image to be transferred to the transfer sheet, a position sensor for detecting the position of aid holder after the holder has been accelerated and decelerated by the control means, processing means for computing a corrective value from the difference between a position signal from the position sensor and the positioning reference signal from the positioning reference signal setting means, and speed correcting means for adjuting the speed of movement of the holder based on the corrective value from the processing means, the arrangement being such that after the holder has been accelerated and decelerated and before the next visible image is transferred, the speed of movement of the holder can be adjusted by the speed correcting means to relatively position the transfer sheet and the next toner image.

To take into account the positional relationship between the image transfer region and the sheet clamping position upon acceleration and deceleration of the holder, the holder is accelerated immediately after the trailing end of the transfer sheet has left the image transfer region upon completion of the image transfer and delivery of the transfer sheet off the holder, and is decelerated to a normal speed before the clamp on the holder reaches the sheet clamping position.

Where the transfer sheet is considerably long, the clamp may be positioned too closely to the sheet clamping position when the trailing end of the transfer sheet has left the image transfer region, and the image forming process would not be substantially speeded up even by accelerating and decelerating the holder. In this case, the holder is not accelerated and decelerated. Thus, control of acceleration/deceleration of the holder can be effected by taking into account the positional relationship between the sheet clamping position and the image transfer region as well as the length of the transfer sheet.

In the case where plural images are required to be transferred onto a transfer sheet for forming a single image, the holder may or may not be accelerated and decelerated between successive image transfer cycles. The speed of rotation of the holder may be brought back to the normal speed before the clamp reaches the sheet clamping position, and the holder may be accelerated and decelerated after the transfer sheet has been clamped.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
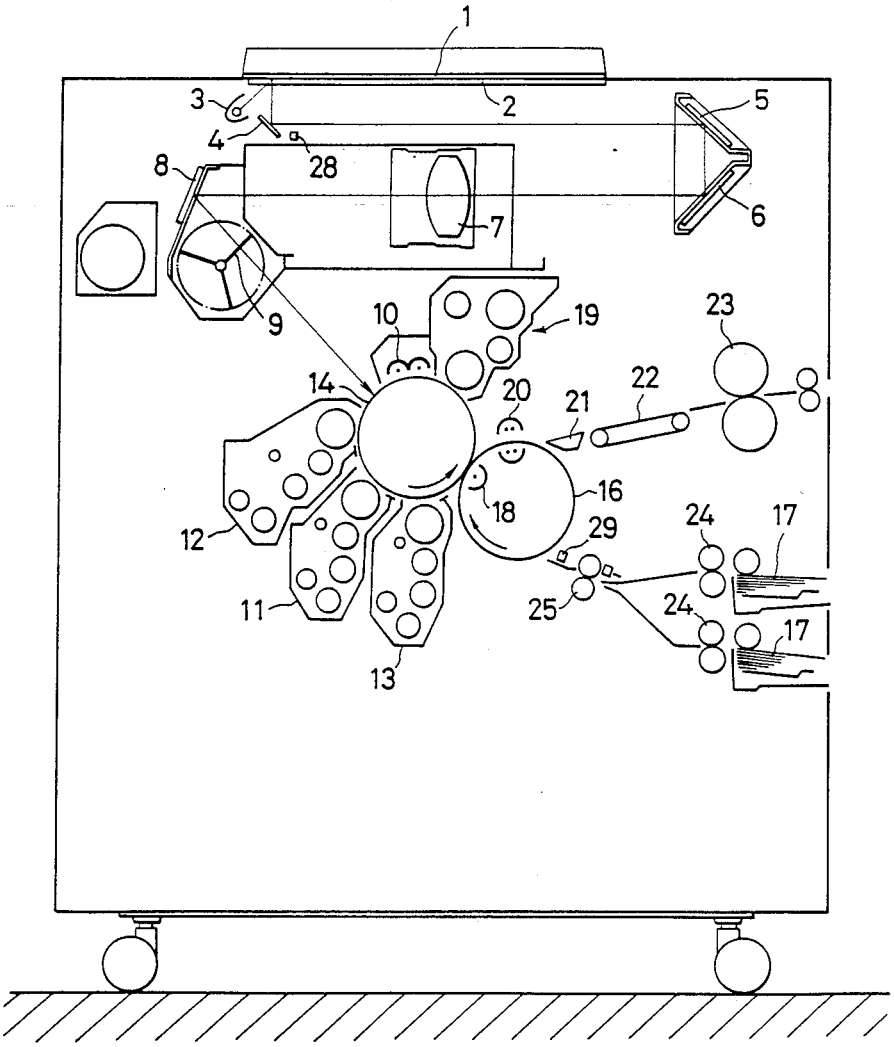
FIG. 1 is a schematic elevational view of a color copying machine according to an embodiment of the present invention.

Various other objects, features and attendant advantages of the present invention will be more fully appreciated as the same becomes better understood from the following detailed description when considered in connection with the accompanying drawings in which like reference characters designate like or corresponding parts throughout the several views and wherein FIG. 1 shows a color copying machine with a platen 2 for placing thereon an original 1 to be copied. The original 1 placed on the platen 2 is illuminated by a light source 3. Light reflected by the original 1 is reflected by a first mirror 4, a second mirror 5, and a third mirror 6, passes through a lens 7, and is then reflected by a fourth mirror 8 to pass through a color-separation filter 9 onto the photosensitive surface of a photosensitive body 14 serving as a latent image carrier which, in the illustrated embodiment, is in the form of a rotatable drum. The surface of the photosensitive body 14 is uniformly charged by a charger 10, so that an electrostatic latent image corresponding to the image on the original 1 is formed thereon upon exposure to the light from the original 1.

The electrostatic latent image is first developed into a visible cyan (C) image by a cyan image developing unit 11. The visible cyan image is transferred by a transfer charger 18 from the photosensitive body 14 onto a transfer sheet 17 of paper wound around an image transfer drum 16 serving as a holder. Any remaining toner on the photosensitive body 14 is removed by a cleaning unit 19. The above process is also carried out to form visible magenta (M) and yellow (Y) images successively with respective magenta and yellow image developing units 12, 13 and then transfer the images successively onto the transfer sheet 17 in mutual image registry, so that a visible color iamge of toner can be formed on the transfer sheet 17.

The transfer sheet 17 with the color image formed thereon is separated from the image transfer drum 16 by a separation charger 20, and travels past a separation finger 21 and a suction feed belt 22 to fixing rollers 23 which rotate at a constant speed. The transfer sheet 17 is gripped by the fixing rollers 23 which heat the transfer sheet 17 to fix the image thereto, and then discharged out of the copying machine.

When a transfer sheet 17 is to be held on the image transfer drum 16, the transfer sheet 17 is fed from a sheet stack by sheet feed rollers 24 until its leading end is engaged by a resist roller 25. The resist roller 25 is rotated at a prescribed timing to allow the transfer sheet 17 to move toward the image transfer drum 16 until its leading end is clamped by a clamp (described later) on the image transfer drum 16. A scanner reference position sensor 28 is located at the home position of an optical scanner, and a drum reference position sensor 29 is positioned in confronting relation to the image transfer drum 16.

Figure 2:
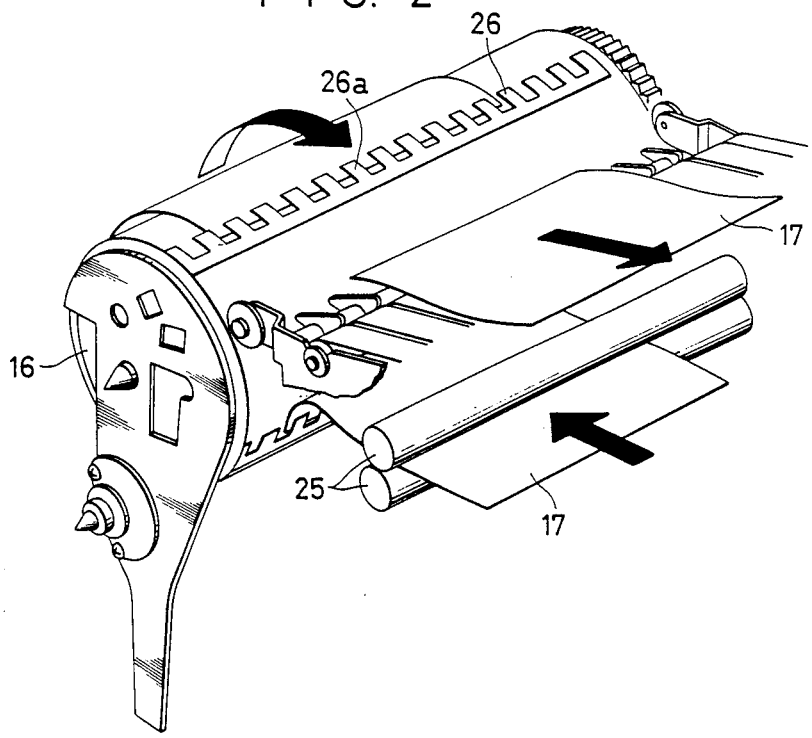
FIG. 2 is a perspective view of an image transfer drum of the color copying machine shown in FIG. 1.

As shown in FIG. 2, the image transfer drum 16 has a reference signal mark 26a positioned in confronting relation to the drum reference position sensor 29, and a clamp 26 for clamping the leading end of a transfer sheet 17. The transfer sheet 17 fed from the resist roller 25 toward the image transfer drum 16 is clamped by the clamp 26 and wound around the image transfer drum 16 in the direction of the arrow.

Figure 3:
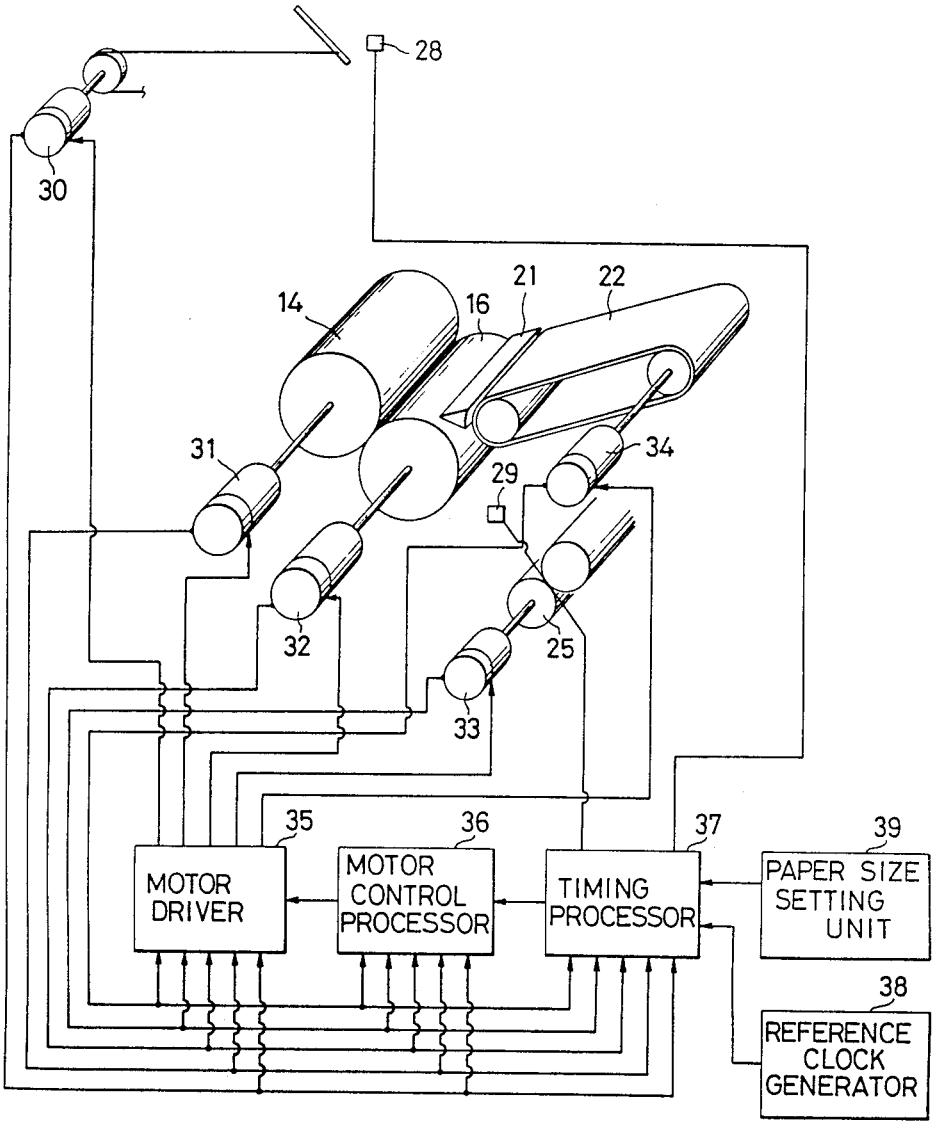
FIG. 3 is a perspective view, partly in block form, showing a control system of the color copying machine of FIG. 1.

FIG. 3 shows a control system for controlling operation of various members of the color copying machine shown in FIG. 1. The control system includes a first servomotor 30 for operating the optical scanner, a second servomotor 31 for rotating the photosensitive body 14, a third servomotor 32 for rotating the image transfer drum 16, a fourth servomotor 33 for rotating the resist roller 25, and a fifth servomotor 34 for operating the feed belt 22, the first through fifth servomotors 30 through 34 being energizable at prescribed respective timings. The servomotors 30 through 34 are connected to a motor driver 35, a motor control processor 36, and a timing processor 37 which is supplied with signals from a reference clock generator 38 and a paper size setting unit 39.

Figure 4:
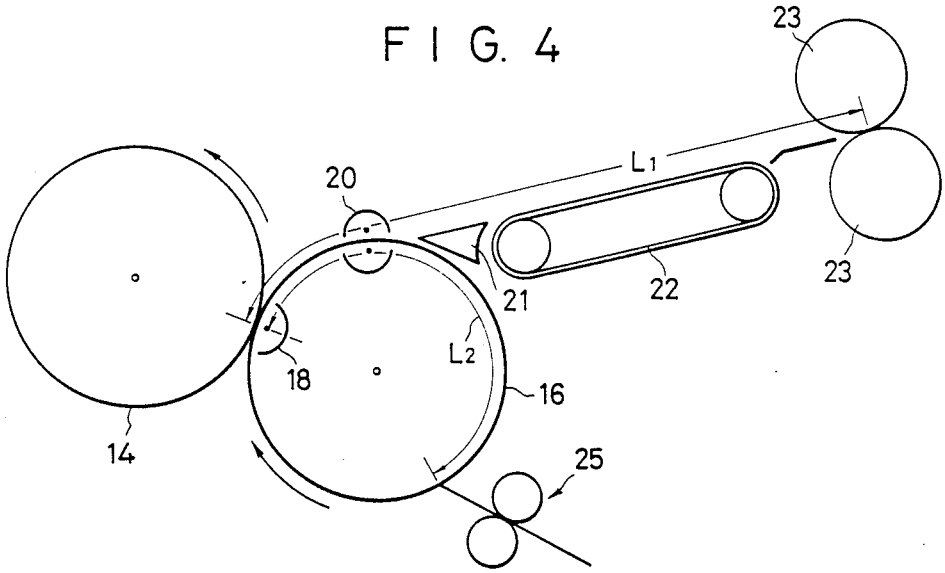
FIG. 4 is a schematic view showing a controllable region in the color copying machine of FIG. 1.

Controlled operation of the color copying machine will be described below with reference to FIGS. 4, 5, 6 as well as FIGS. 1 through 3.

In this embodiment, where the length of a transfer sheet is greater than a feeding distance L1 (FIG. 4), the image transfer drum 16 is not controlled for acceleration and deceleration, and where the length of a transfer sheet is smaller than the distance L1, the image transfer drum 16 is controlled for acceleration and deceleration.

Prior to starting a copying process, data items such as the size of a transfer sheet 17 to be used, the magnification, and the number of copies to be made, are set in a step 1. The size of a transfer sheet 17 is set by the paper size setting unit 39, and a paper size signal indicative of the set size is applied by the paper size setting unit 39 to the timing processor 37 of the control system shown in FIG. 3, in which the paper size signal is stored at a prescribed address in a RAM. Then, a step 2 ascertains whether a copy button is depressed or not, and a step 3 starts controlling a copying process.

Based on the paper size signal from the paper size setting unit 39, the first servomotor 30 is rotated to operate the optical scanner to effect scanning for a distance corresponding to the transfer sheet size, and then the first servomotor 30 is reversed at a given speed to return the optical scanner to its initial position. The scanning cycle is repeated three times to form electrostatic latent images of respective colors corresponding to the image of an original on the photosensitive body 14. The electrostatic latent images of the respective colors are successively developed by corresponding toners of complementary colors when the electrostatic latent images pass through the developing units 11, 12, 13.

After the electrostatic latent images have been developed, the toner images are successively transferred onto the transfer sheet 17. Prior to the toner image transfer, a step 4 ascertains whether the length Lt of the transfer sheet 17 in the direction in which it is fed is equal to or smaller than the feeding distance L1, or not. If the length Lt is longer than the distance L1 ($Lt > L1$), then the image transfer drum 16 is not controlled for acceleration and deceleration, i.e., it is controlled normally. When the image transfer drum 16 is normally controlled, it is not accelerated and decelerated between image transfer cycles and when the transfer sheet is delivered to the image fixing device after the image transfer. When $Lt > L1$, the trailing end of the transfer sheet 17 may happen to be in an image transfer position whereas the leading end thereof may be gripped between the fixing rollers 23. If the image transfer drum 16 were accelerated and decelerated under this condition, a toner image would be transferred out of registry with the proper image transfer position, and the transfer sheet 17 would sag in front of the fixing rollers 23, allowing unfixed toner to be attached to surrounding parts and causing the visible toner image to be ruined. To prevent the above problems, the image transfer drum 16 is not controlled for acceleration and deceleration when $Lt > L1$ in the step 4.

Figure 5:
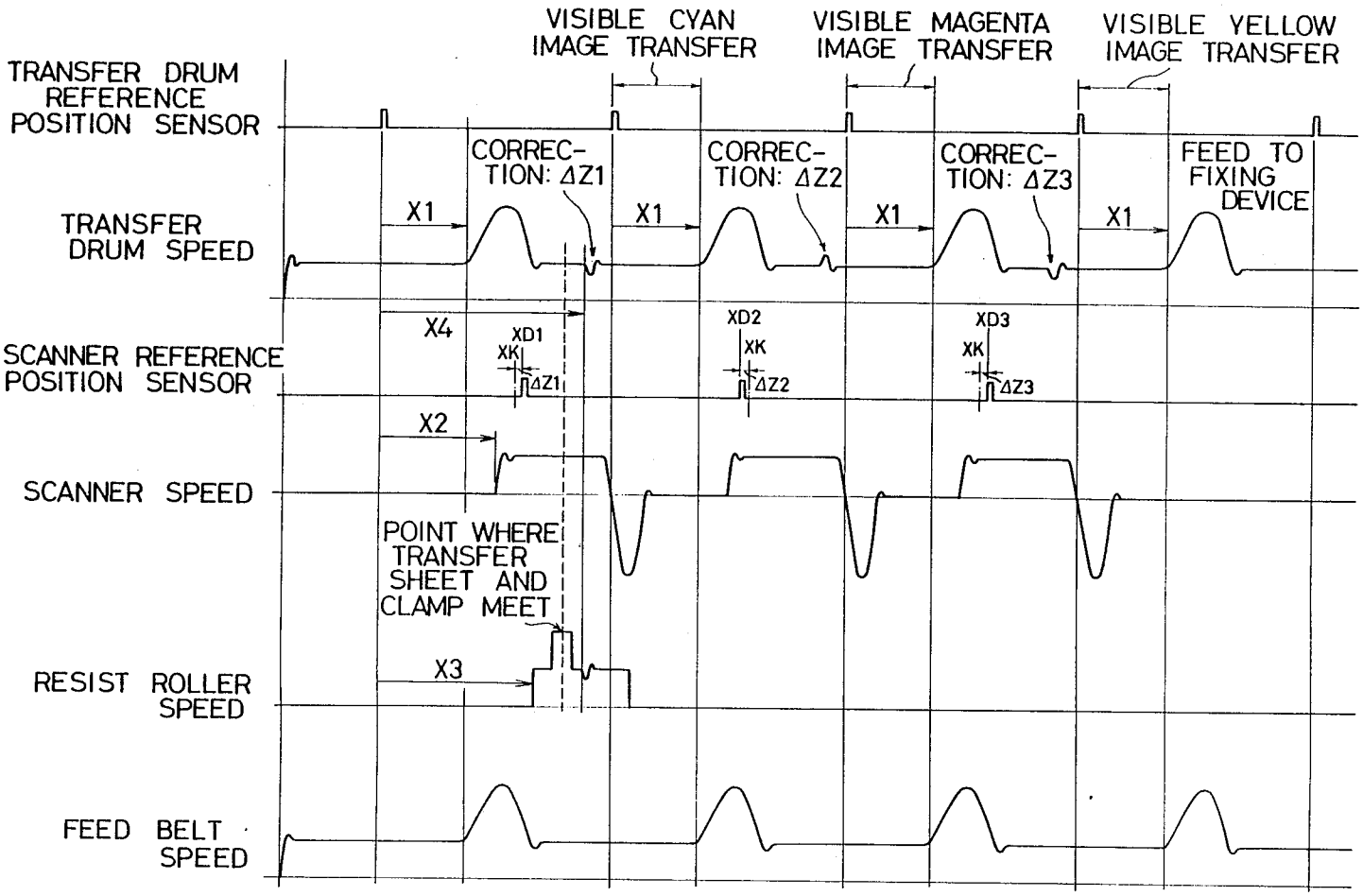
FIG. 5 is a timing chart of operation of various components of the color copying machine of FIG. 1.
Figure 6:
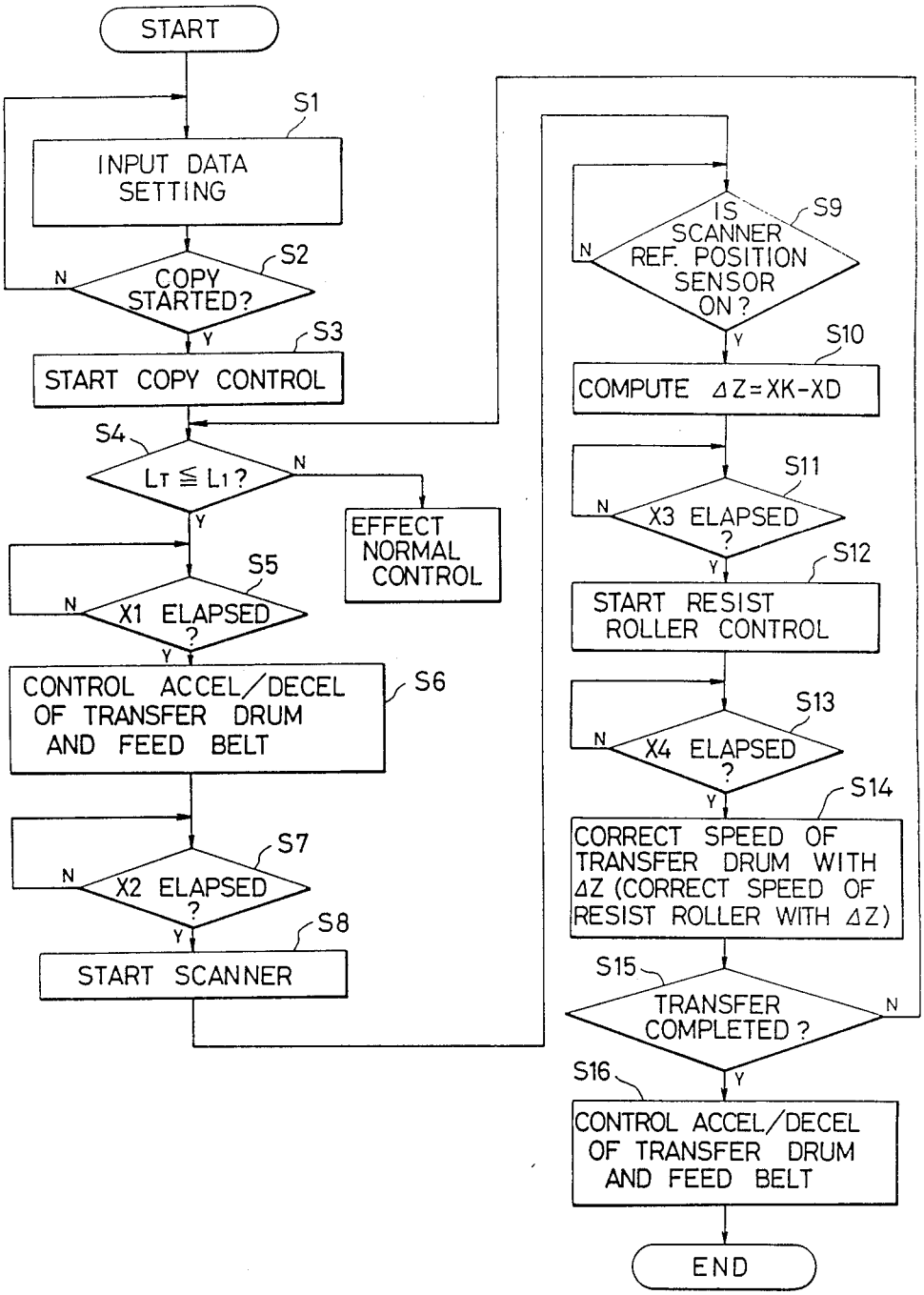
FIG. 6 is a flowchart of a copying process effected by the color copying machine of FIG. 1.

In the image transfer period, the image transfer drum 16 is required to rotate at a constant speed in exact synchronism with the photosensitive body 14 (see flat sections of the transfer drum speed curve in FIG. 5). When the reference signal mark 26a (FIG. 2) of the image transfer drum 16 passes in the vicinity of the drum reference position sensor 29, a drum reference position signal (image transfer starting signal) is generated from the drum reference position sensor 29 as shown in FIG. 5. If $Lt \leqq L1$ in the step 4, then a step 5 ascertains whether a time period X1 (FIG. 5) has elapsed or not. If elapsed, control goes to a step 6 in which the image transfer drum 16 and the feed belt 22 are controlled for acceleration and deceleration. The time period S1 is a time in which to transfer a visible toner image onto the transfer sheet 17. In the step 5 at the stage just described, the transfer sheet 17 is not held onto the image transfer drum 16.

The copying time can be reduced by rotating the image transfer drum 16 at a higher speed when a visible image is not transferred. While in this embodiment the feed belt 22 is accelerated and decelerated each time the image transfer drum 16 is rotated, the feed belt 22 may not be controlled in such a manner but may be accelerated and decelerated only when the transfer sheet 17 is fed by the feed belt 22.

More specifically, the feed belt 22 is accelerated and decelerated in synchronism with acceleration and deceleration of the image transfer drum 16 because if only the image transfer drum 16 were accelerated and decelerated while the suction feed belt 22 is feeding the transfer sheet 17 under suction, the image transfer sheet 17 would be flexed due to the difference between the speed of movement of the feed belt 22 and the speed of travel of the transfer sheet 17. By suitably adjusting the suction force and the coefficient of friction of the feed belt 22, the transfer sheet 17 may be allowed to slip with respect to the feed belt 22 when the difference is produced between the speed of movement of the feed belt 22 and the speed of travel of the transfer sheet 17 due to acceleration and deceleration of the image transfer drum 16. Thus, the transfer sheet 17 is prevented from flexing since the difference between the speed of movement of the feed belt 22 and the speed of rotation of the image transfer drum 16 can be absorbed by the slippage of the transfer sheet 17 with respect to the feed belt 22. Therefore, acceleration and deceleration of the feed belt 22 in synchronism with the rotation of the image transfer drum 16 is not necessarily required by the present invention.

After a step 7 has confirmed that a time period X2 has elapsed after the drum reference position signal has been generated, the optical scanner starts being moved in a step 8. Then, a step 9 checks if the scanner reference position sensor 28 is turned on. A predicted scanner position reference position timing XK is established in advance in the control program. The difference between the predicted scanner position reference position timing and an actual scanner timing XD which is detected by the scanner reference position sensor 28 is computed as a corrective value ΔZ in a step 10. The corrective value ΔZ is computed by the timing processor 37 (FIG. 3) having a CPU and temporarily stored at a prescribed address in a RAM of the timing processor 37. The predicted scanner position reference position timing XK serves a reference signal for allowing relative positioning as when the leading ends of the transfer sheet 17 and the toner image are to be aligned with each other or the leading end of the image is to be displaced a desired distance from the leading end of the transfer sheet 17 in order to produce a desired margin in a next image transfer cycle.

In this embodiment, the predicted scanner position reference position timing XK is established with reference to the operation timing of the optical scanner. However, such a positioning signal may be established with reference to the operation timing of the photosensitive body 14.

Then, a step 11 ascertains whether a time period X3 has elapsed after the drum reference position signal has been issued. Upon elapse of the time period X3, the resist roller 25 starts rotating in a step 12. In order that the leading end of the transfer sheet 17 will be inserted below the clamp 26 with its tip end opened while the transfer sheet 17 is being slightly flexed without being skewed, the resist roller 25 is rotatable at two selective speeds as shown in FIG. 5. The transfer sheet 17 and the clamp 26 meet each other at an intermediate point in an interval during which the resist roller 25 rotates at a second speed higher than a first speed. The clamping of the transfer sheet 17 is completed at the timing corresponding to the intermediate point in the high-speed interval of the resist roller 25. Thereafter, the speed of rotation of the resist roller 25 is reduced substantially to the first speed.

A step 13 ascertains whether a time period X4 has elapsed after the drum reference position signal has been issued. The timing at which the time period X4 elapses is selected to lie intermediate between the clamping of the transfer sheet 17 and a next drum reference position signal, i.e., the completion of the transfer sheet clamping and the starting of an image transfer cycle. If the time period X4 has elapsed in the step 13, then control goes to a step 14 in which the corrective value ΔZ computed in the step 10 is read out and used to finely adjust or correct the speeds of rotation of the image transfer drum 16 and the resist roller 25. As a result of such fine adjustment, the leading end of the transfer sheet 17 held on the image transfer drum 16 is brought into registry with the leading end of a first toner image to be transferred onto the transfer sheet 17.

More specifically, the fine adjustment of the rotational speeds is effected as follows: The corrective value Z stored in the RAM of the timing processor 37 is read out and applied to the motor control processor 36 which then converts the corrective value ΔZ to a corresponding speed control signal, which is sent to the motor driver 35 for thereby controlling the rotation of the third and fourth servomotors 32, 33 which drive the image transfer drum 16 and the resist roller 25, respectively.

Unless the speeds of rotation of the image transfer drum 16 and the resist roller 25 were corrected in synchronism with each other, the transfer sheet 17 would be subjected to an unwanted sag between the image transfer drum 16 and the resist roller 25, or an undue tension would be applied to the transfer sheet 17.

As illustrated in FIG. 5, the acceleration/deceleration control and subsequent speed correction with the corrective value ΔZ of the image transfer drum 16 are then effected each time a toner image is transferred by repeating the control loop from the steps 4 through 14 and back to the step 4 through a step 15. In the embodiment of FIG. 5, the signal detected by the scanner reference position sensor 28 is delayed from the predicted scanner reference position timing in each of the first and third cycles of rotation of the image transfer drum 16, and the signal from the scanner reference position sensor 28 is earlier than the predicted scanner reference position timing the second cycle of rotation of the image transfer drum 16. Therefore, the speed of rotation of the image transfer drum 16 has different curves corrected by corrective values ΔZ1, ΔZ2, ΔZ3, respectively. The speed correction with ΔZ of the resist roller 25 may be effected once after the transfer sheet 17 has been clamped. In each of the repeated loops from the steps 4 through 14 and back to the step 4 via the step 15, a toner image is transferred to the transfer sheet in the step 5. After the toner images have been transfered three times, control goes from the step 15 to a step 16 which is the same as the step 6, followed by an image fixing process The relationship between the clamping of the image transfer sheet and the speed correction of the drum will be described below in greater detal. It may be necessary during an interval in which no image is transfered for the clamp 26 on the image transfer drum 16 to clamp the transfer sheet 17.

(1) Unless the clamp 26 and the leading end of the transfer sheet 17 were properly positioned with respect to each other, the clamp 26 would fail to clamp the transfer sheet 17, which could not be fed as desired.

(2) In order that the transfer sheet 17 will be properly clamped, any skew of the transfer sheet 17 and variations in the relative position of the transfer sheet 17 and the clamp 26 should be absorbed or eliminated. Such transfer sheet skew and variations in the relative position can effectively be removed by overfeeding the transfer sheet 17 for 3 to 10 mm beyond the position in which the transfer sheet 17 and the clamp 26 should be registered.

To meet the condition (1) above, acceleration/deceleration control of the image transfer drum 16 should be finished before the transfer sheet 17 is clamped. More specifically, where the servomotor 32 for driving the image transfer drum 16 is large in size and capacity, the image transfer drum 16 can accurately be controlled for acceleration/deceleration to bring the clamp 26 and the leading end of the transfer sheet 17 into relatively exact registry. However, the servomotor 32 of large size and capacity presents a obstacle to efforts to reduce the size and weight of the copying machine, and results in an increase in cost. The servomotor 32 may be small in size and capacity and inexpensive if acceleration and deceleration of the image transfer drum 16 are carried out using the motor capability to its upper limit, and if the motor is controlled immediately before the transfer sheet 17 is clamped upon completion of the acceleration/deceleration control so that the image transfer drum 16 will be rotated at a speed suitable for clamping the transfer sheet 17.

Where the image transfer sheet 17 is a relatively rigid sheet such as of cardboard, the image transfer drum 16 may be subjected to a force in its accelerating direction when the transfer sheet 17 is clamped while meeting the condition (2) above. This may cause the image transfer drum 16 to become out of synchronism. To eliminate this difficulty, the clamping position should be selected such that a transfer sheet of maximum size will be supplied when no image is transferred. More specifically, as shown in FIG. 4, the clamp position should be selected such that the distance L2 from the transfer charger 18 to the clamping position will be equal to or larger than the maximum size Lmax of transfer sheet 17 (L2>Lmax).

When a relatively rigid transfer sheet such as of cardboard is clamped by the clamp, the speed of rotation of the image transfer drum 16 may be changed slightly at the time the leading end of the transfer sheet hits the clamp. In view of this, the correction of speed of the image transfer drum 16 can properly be effected sufficiently after the rotation of the image transfer drum 16 has started being controlled. The similar correction timing appears on the curve of the resist roller speed shown in FIG. 5. According to this resist roller speed curve, the speed correction is effected not immediately after the speed has been reduced to the first speed, but with a slight time delay.

Figure 7:
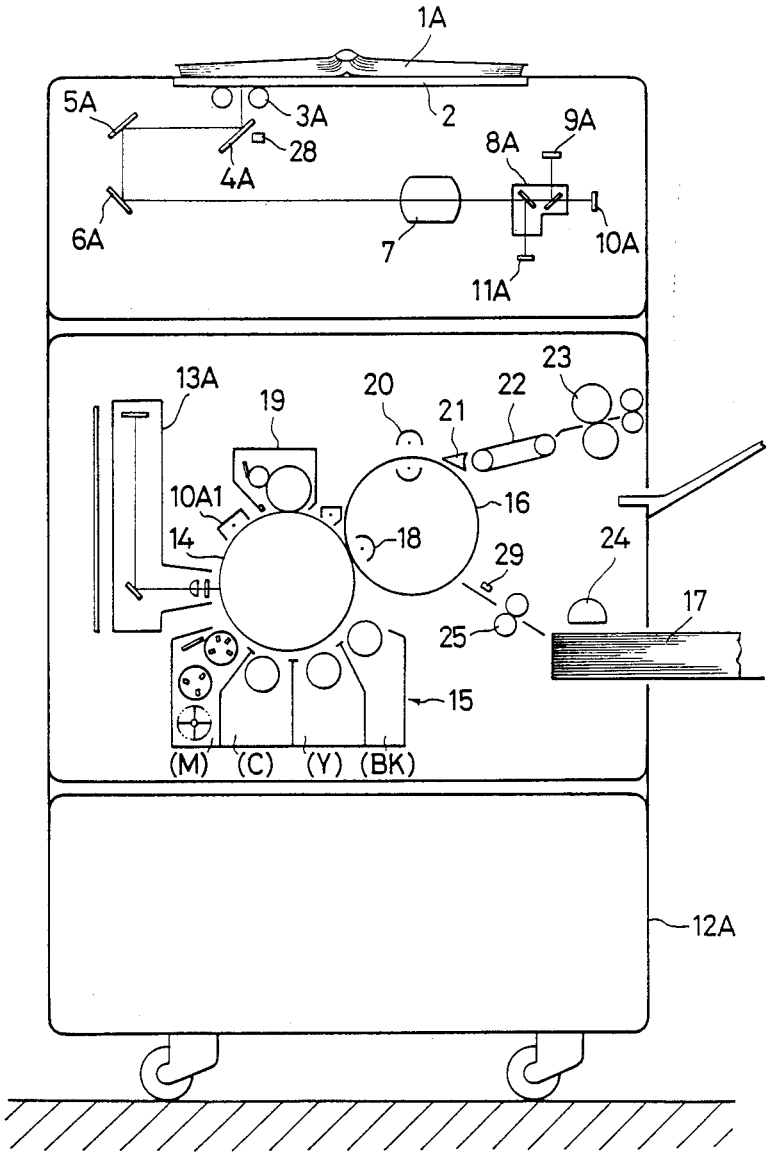
FIG. 7 is a schematic elevational view of a digital color copying machine according to another embodiment of the present invention.

FIG. 7 schematically shows a digital color copying machine according to another embodiment of the present invention. Those parts in FIG. 7 which are identical to those shown in FIG. 1 are denoted by identical reference numerals.

An original 1A is placed on a platen 2 and illuminated with a source source 3A. Light reflected by the original 1A is reflected by a first mirror 4A, a second mirror 5A, and a third mirror 6A which are movable, and passes through an image forming lens 7 into a dichroic prism 8A by which the light is separated into lights of three wavelengths, i.e., red (R) light, green (G) light, and blue (B) light. The separated lights are applied respectively to solid-state imaging devices 9A, 10A, 11A comprising CCDs.

Output signals from the CCDs 9A, 10A, 11A are processed by an image processing unit l2A and converted thereby into binary signals for recording the original image in colors, black (BK), yellow (Y), magenta (M), and cyan (C). These signals are used to modulate a laser beam emitted by a laser beam writing unit 13A and applied to a photosensitive body or drum 14.

The peripheral surface of the photosensitive body 14 is uniformly charged by a charging corona unit 10A, and an electrostatic latent image is formed by the laser beam on the charged surface of the photosensitive body 14.

The electrostatic latent image is first developed into a black toner image by an image developing unit 15, and the developed toner image is transferred by a transfer corona unit 18 onto a transfer sheet 17 wound around an image transfer drum 16 serving as a holder. Remaining toner on the photosensitive body 14 is removed by a cleaning unit 19. The above process is repeated to successively form cyan (C), magenta (M), and yellow (Y) images on the photosensitive body 14, from which they are successively transferred onto the transfer sheet 17 to produce a visible toner color image thereon. The transfer sheet 17 with the visible color image thereon is separated from the image transfer drum 16 by a separation charger 20, and then fed past a separation finger 21 and a suction feed belt 22 to an image fixing unit 23 by which the toner image is fixed. Thereafter, the transfer sheet 17 is discharged out of the copying machine.

The transfer sheet 17 is fed from a sheet stack by sheet feed rollers 24 until its leading end is engaged by a resist roller 25. The resist roller 25 is rotated at a prescribed timing to allow the transfer sheet 17 to move toward the image transfer drum 16 until its leading end is clamped on the image transfer drum 16. A scanner reference position sensor 28 is located at the home position of an optical scanner, and a drum reference position sensor 29 is positioned in confronting relation to the image transfer drum 16.

The details of the image transfer drum 16 and the manner in which the transfer sheet 17 is fed by the resist roller 25 and clamped are exactly the same as the embodiment shown in FIGS. 1 and 2.

Figure 8:
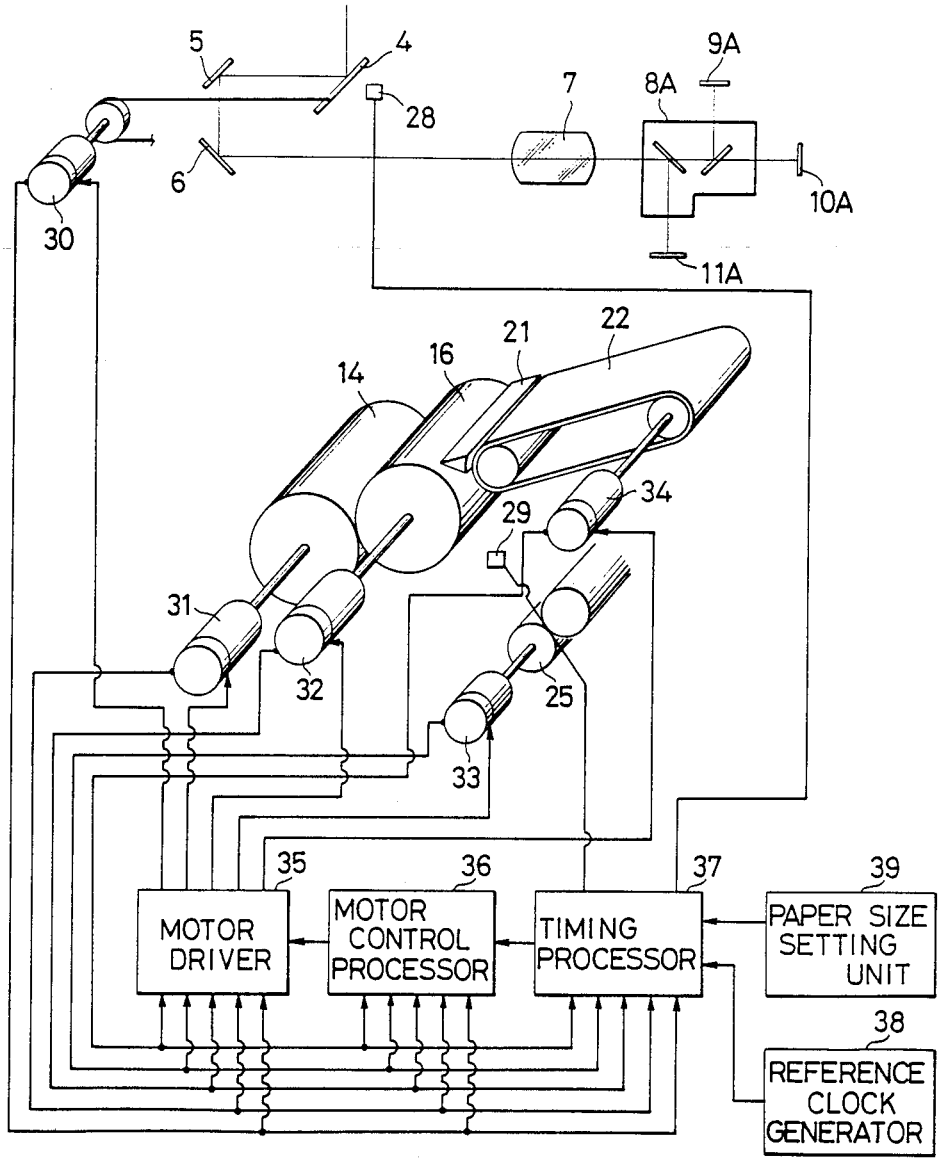
FIG. 8 is a perspective view, partly in block form, showing a control system of the digital color copying machine of FIG. 7.

FIG. 8 shows a control system for controlling operation of various members of the digital color copying machine shown in FIG. 7. The control system includes a first servomotor 30 for operating the optical scanner, a second servomotor 31 for rotating the photosensitive body 14, a third servomotor 32 for rotating the image transfer drum 16, a fourth servomotor 33 for rotating the resist roller 25, and a fifth servomotor 34 for operating the feed belt 22, the first through fifth servomotors 30 through 34 being energizable at prescribed respective timings. The servomotors 30 through 34 are connected to a motor driver 35, a motor control processor 36, and a timing processor 37 which is supplied with signals from a reference clock generator 38 and a paper size setting unit 39.

Figure 9:
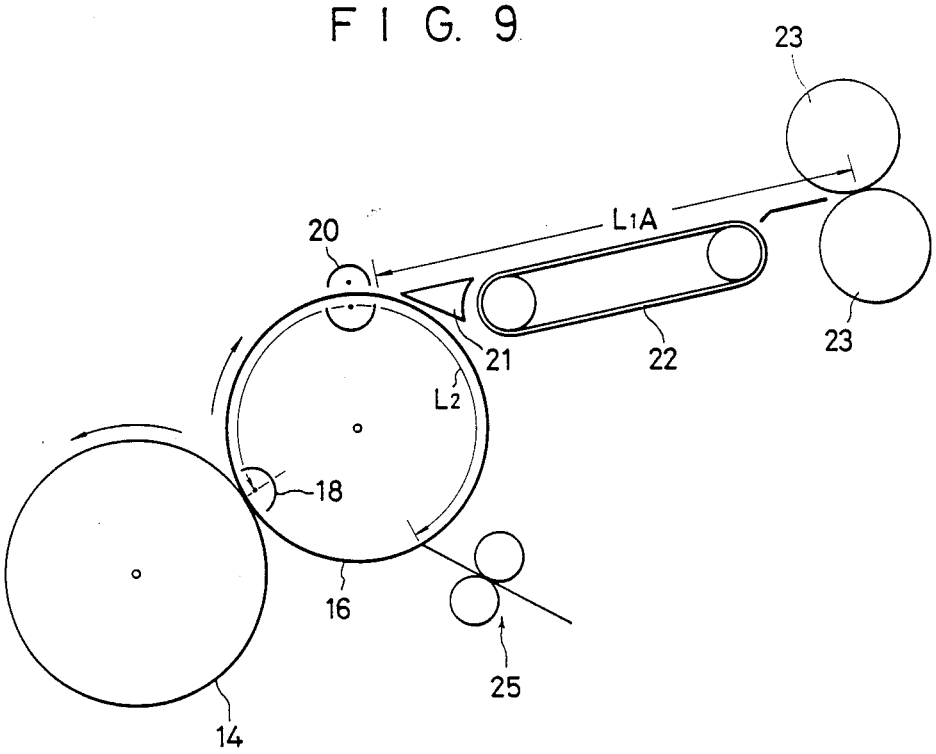
FIG. 9 is a schematic view showing a controllable region in the digital color copying machine of FIG. 7.

Denoted at L1A in FIG. 9 is a distance between the rear end of the separation charger 20, i.e., the sheet separating position, and an image fixing position between the fixing rollers 23.

Where the length of a transfer sheet is larger than the distance L1A, the image transfer drum 16 is not controlled for acceleration and deceleration when the transfer sheet is sent to the fixing rollers 23. This is for the following reasons: In order to prevent an image from being disturbed due to flexing of the transfer sheet and also to prevent an image fixing failure and an image transfer failure at the time the transfer sheet is fed to the image fixing device, acceleration and deceleration of the image transfer drum should be started immediately after the trailing end of the transfer sheet has left the image transfer region, and completed before the leading end of the transfer sheet reaches the image fixing device. If the image transfer drum cannot be rotated through a large angle by such acceleration and deceleration, the purpose of acceleration and deceleration of the image transfer drum to speed up the image forming process cannot effectively be achieved. If a transfer sheet having a length L1A is to be sent to the image fixing device and the image transfer drum is to be controlled for acceleration and deceleration, the image transfer drum must be accelerated and decelerated during a time interval after the leading end of the transfer sheet has left the image transfer region and before it reaches the sheet separating position. In case the distance between the image transfer region and the sheet separating position is small and the length of a transfer sheet is greater than L1A, however, acceleration and deceleration of the image transfer drum are not carried out as they are ineffective when the transfer sheet is fed to the image fixing device. The distance between the sheet separating position and the sheet clamping position is selected to be greater than the length L1A.

A digital color copying process according to the embodiment shown in FIG. 7 is substantially the same as the color coding process of the embodiment of FIG. 1 which has been described with reference to FIG. 6. Since the flowchart of FIG. 6 applies except that "L1" in the step 4 should be changed to "L1A", the copying process of the second embodiment will not be described in detail. The original to be copied may be scanned by the scanner only once. In correcting the speed with Z, each image writing start signal from the laser beam writing unit 13A is used instead of a signal from the scanner reference position sensor. Four toner images (black, cyan, magenta, and yellow images) are required to be transferred onto a transfer sheet in one color copying cycle.

With the arrangement of the present invention, the image forming apparatus may employ a small-size and inexpensive servomotor, can reduce the copying time, and is highly reliable in operation without the possibility of transferring toner images out of registry.

Although certain preferred embodiments have been shown and described, it should be understood that many changes and modifications may be made therein without departing from the scope of the appended claims.

What is claimed is:

1. An image forming apparatus comprising:

a latent image carrier for carrying an electrostatic latent image formed thereon;

an image developing unit for developing the electrostatic latent image on said latent image carrier into a visible image;

a movable holder for holding a transfer sheet thereon;

means for transferring the visible image from said latent image carrier onto the transfer sheet on said holder through an image transfer region;

an image fixing device for fixing the visible image to said transfer sheet; and control means for accelerating and decelerating said holder while the transfer sheet is positioned out of said image transfer region and during an interval after the trailing end of said transfer sheet has left said image transfer region and before the leading end of said transfer sheet reaches said image fixing device when said transfer sheet is delivered from said holder toward said image fixing device.

2. An image forming apparatus comprising:

a latent image carrier for carrying an electrostatic latent image formed thereon;

an image developing unit for developing the electrostatic latent image on said latent image carrier into a visible image;

a movable holder for holding a transfer sheet thereon;

means for transferring the visible image from said latent image carrier onto the transfer sheet on said holder through an image transfer region;

an image fixing device for fixing the visible image to said transfer sheet; and control means for accelerating and decelerating said holder while the transfer sheet is positioned out of said image transfer region and during an interval after the trailing end of said transfer sheet has left said image transfer region and before the leading end of said transfer sheet reaches said image fixing device when said transfer sheet is delivered from said holder toward said image fixing device, said control means including means for disabling acceleration and deceleration of said holder during delivery of said transfer sheet toward said image fixing device when the transfer shet is longer than the length of a feed path from said image transfer region to said image fixing device.

3. An image forming apparatus comprising:

a latent image carrier for carrying electrostatic latent images successively formed thereon;

an image developing unit for developing the electrostatic latent images on said latent image carrier successively into visible images;

a movable holder for holding a transfer sheet thereon;

means for transferring the visible images from said latent image carrier successively onto the transfer sheet on said holder through an image transfer region;

an image fixing device for fixing the visible images to said transfer sheet;

control means for accelerating and decelerating said holder while the transfer sheet is positioned out of said image transfer region;

positioning reference signal setting means for setting a positioning reference signal, after one of said visible images has been transferred onto the transfer sheet, to relatively position said transfer sheet and a next visible image to be transferred to the transfer sheet;

a position sensor for detecting the position of aid holder after said holder has been accelerated and decelerated by said control means;

processing means for computing a corrective value from the difference between a position signal from said position sensor and the positioning reference signal from said positioning reference signal setting means; and speed correcting means for adjuting the speed of movement of said holder based on the corrective value from said processing means, the arrangement being such that after said holder has been accelerated and decelerated and before the next visible image is transferred, the speed of movement of said holder can be adjusted by said speed correcting means to relatively position said transfer sheet and said next toner image.

4. An image forming apparatus comprising:

a latent image carrier for carrying an electrostatic latent image formed thereon;

an image developing unit for developing the electrostatic latent image on said latent image carrier into a visible image;

a movable holder for holding a transfer sheet thereon, said holder having a clamp for clamping a leading end of the transfer sheet in a sheet clamping position;

means for transferring the visible image from said latent image carrier onto the transfer sheet on said holder through an image transfer region;

an image fixing device for fixing the visible image to said transfer sheet;

control means for accelerating and decelerating said holder while the transfer sheet is positioned out of said image transfer region, said control means including means for completing acceleration and deceleration of said holder after the trailing end of said transfer sheet has left said image transfer region and before the clamp of said holder reaches said sheet clamping position.

5. An image forming apparatus comprising:

a latent image carrier for carrying an electrostatic latent image formed thereon;

an image developing unit for developing the electrostatic latent image on said latent image carrier into a visible image;

a movable holder for holding a transfer sheet thereon, said holder having a clamp for clamping a leading end of the transfer sheet in a sheet clamping position;

means for transferring the visible image from said latent image carrier onto the transfer sheet on said holder through an image transfer region;

an image fixing device for fixing the visible image to said transfer sheet;

control means for accelerating and decelerating said holder while the transfer sheet is positioned out of said image transfer region, said control means including means for effecting acceleration and deceleration of said holder after the trailing end of said transfer sheet has left said image transfer region, for completing acceleration and deceleration of said holder before the clamp of said holder reaches said sheet clamping position, and for disabling acceleration and deceleration of said holder when the acceleration and deceleration of said holder are ineffective dependent on the length of said transfer sheet after the visible image has been transferred onto said transfer sheet.

6. A sheet handling device for an image forming apparatus, comprising:

a movable sheet holder for holding a transfer sheet thereon, while moving said sheet over a prescribed image forming path;

control means for accelerating and decelerating said holder over only part of said path.

7. A sheet holding device according to claim 6, wherein the acceleration and deceleration of said holder depends on the size of said sheet.

8. A sheet handling device for an image forming apparatus, comprising:

an optical scanner;

a photosensitive body;

an image transfer drum;

a resist roller;

a feed belt;

first servomotor for operating said optical scanner;

second servomotor for rotating said photosensitive body;

third servomotor for rotating said image transfer drum;

fourth servomotor for rotating said resist roller;

fifth servomotor for operating said feed belt; and a motor driver for controlling said first through fifth servomotors.

9. A sheet handling device according to claim 8, further comprising:

a reference clock;

a paper size setting means;

first reference position sensor for said optical scanner;

second reference position sensor for said drum; and a timing processor connected to said reference clock, size setting means, first reference position sensor, second reference position sensor and said motor driver for producing a control signal to control the motor driver.

* * * * *